US007240667B2

(12) United States Patent
Dölker

(10) Patent No.: US 7,240,667 B2
(45) Date of Patent: Jul. 10, 2007

(54) METHOD AND APPARATUS FOR CONTROLLING THE PRESSURE IN A COMMON RAIL SYSTEM

(75) Inventor: Armin Dölker, Immenstaad (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 65 days.

(21) Appl. No.: 11/287,836

(22) Filed: Nov. 28, 2005

(65) Prior Publication Data

US 2006/0130813 A1 Jun. 22, 2006

(30) Foreign Application Priority Data

Dec. 21, 2004 (DE) ..... 10 2004 061 474

(51) Int. Cl.
*F02M 59/36* (2006.01)
*F02M 69/46* (2006.01)

(52) U.S. Cl. ..... 123/456; 123/458

(58) Field of Classification Search ..... 123/456, 123/458

See application file for complete search history.

(56) References Cited

U.S. PATENT DOCUMENTS 4,719,889 A * 1/1988 Amann et al. ..... 123/447
4,884,545 A * 12/1989 Mathis ..... 123/447
5,711,275 A * 1/1998 Minagawa et al. ..... 123/458
6,234,148 B1 * 5/2001 Hartke et al. ..... 123/447
6,253,734 B1 * 7/2001 Rembold et al. ..... 123/446
6,647,965 B1 * 11/2003 Breeden ..... 123/446
6,715,470 B2 * 4/2004 Takahashi ..... 123/458
6,823,845 B2 * 11/2004 Schueler ..... 123/446
2005/0224049 A1 * 10/2005 Eser ..... 123/446
2007/0023009 A1 * 2/2007 Elliott et al. ..... 123/446

FOREIGN PATENT DOCUMENTS

| | | |
|---|---|---|
| DE | 198 02 583 | 8/1999 |
| DE | 100 29 033 | 6/2001 |
| DE | 101 62 989 | 10/2001 |
| DE | 103 30 466 | 10/2004 |

* cited by examiner

*Primary Examiner*—Thomas Moulis
(74) *Attorney, Agent, or Firm*—Klaus J. Bach

(57) ABSTRACT

In a common rail operating method and system, an arrangement for controlling the rail pressure is provided with a rail pressure controller including a current control circuit for controlling a suction throttle valve operating current (i) which valve is arranged in the fuel supply line to a high pressure pump supplying high pressure fuel to the common rail. The suction valve operating current control circuit includes a preliminary control value generator which serves also as an emergency control signal generator for the control of the suction valve if an error occurs in the system at least to permit an orderly engine shutdown procedure.

19 Claims, 5 Drawing Sheets

METHOD AND APPARATUS FOR CONTROLLING THE PRESSURE IN A COMMON RAIL SYSTEM

BACKGROUND OF THE INVENTION

The invention relates to a method and an apparatus for controlling the fuel pressure in a common rail fuel injection system, wherein a rail pressure deviation is determined by a comparison of the desired and the actual rail pressure and wherein a rail pressure control value for controlling a throttle valve by way of a rail pressure controller is calculated from the rail pressure control deviation and the fuel supply to a high pressure pump and, consequently, the rail pressure is controlled.

In a common rail fuel injection system, the fuel is pumped by a low-pressure pump from the fuel tank to a high-pressure pump. The high-pressure pump supplies the fuel with an increased pressure to a rail (high pressure storage). In the flow path between the low pressure pump and the high pressure pump, there is a controllable suction throttle valve by way of which the fuel admission to the high pressure pump is controlled.

DE 103 30 466 B3 discloses such a common rail system wherein the rail pressure is controlled by an electronic control unit disposed in a rail pressure control circuit providing a control value corresponding to the rail pressure. By a filter arranged in a feedback branch, noise signals are suppressed such as signals which have the same frequency as the injection frequency or the pumping frequency of the high pressure pump. The filtered rail pressure signal is compared as rail pressure actual value with a desired rail pressure value resulting in a rail pressure control deviation. From the rail pressure control deviation, the rail pressure controller determines a control value, that is a desired volume flow. This control value is then converted to a pulse-width modulated signal (PWM). This signal is applied to the suction throttle valve for controlling the rail pressure.

The ohmic resistance of the suction throttle valve winding however changes with the temperature. This means that the rail pressure controller calculates different control values for the same stationary operating point, for example, different integration components. During stationary engine operation, the integration component of the rail pressure controller is additionally deposited in a leakage performance graph. Upon failure of the rail pressure sensor then, instead of the control value computed by the rail pressure controller, a value from the leakage performance graph is used. However, this may be problematic as the quality the rail pressure control may then suffer upon failure of the pressure sensor.

A measure for decreasing the temperature dependency of a rail pressure control circuit is known from DE 198 02 583 A1. Here, the rail pressure controller is provided with a current control circuit. The guide value of the current control circuit corresponds to a desired electric current, which is provided by the rail pressure controller as a control value. By way of a current sensor, the electric current which flows through the winding of a pressure control valve is determined from the actual current value. From the control deviation between the desired current value and the actual current value the current controller determines a control value. The current control of the pressure valve is absolutely necessary since the pressure control valve is arranged at the high pressure side and controls the fuel release from the rail back to the fuel tank. Since a pressure of about up to 180 bar is present in the rail, during a throttling control to a pressure of 0 bar, a large amount of heat is released. From this as well as by the application of the electric current the temperature of the winding is increased. With the control circuit shown, a pulse width modulated signal is applied to current controller as input signal. Since a current controller must be highly dynamic the application of an unfiltered PWM signal may result in an instability of the current control circuit. There is no backup for the current control circuit in case of a current measurement error or failure.

It is therefore the object of the present invention to provide a stable and temperature-independent rail pressure control circuit with a suction throttle valve which additionally includes an error protection.

SUMMARY OF THE INVENTION

In a common rail operating method and system, an arrangement for controlling the rail pressure is provided with a rail pressure controller including a current control circuit for controlling a suction throttle valve operating current (i) which valve is arranged in the fuel supply line to a high pressure pump supplying high pressure fuel to the common rail. The suction valve operating current control circuit includes a preliminary control value generator which serves also as an emergency control signal generator for the control of the suction valve if an error occurs in the system at least to permit an orderly engine shutdown procedure.

The invention provides for a rail pressure control circuit with a subordinated current control circuit wherein the control value of the rail pressure controller is the guide value for the current control circuit and, at the same time, the input valve for a preliminary control. To provide an emergency running capability as an error protection, it is provided that, upon occurrence of non-logical actual current values, the current controller is de-activated and the PWM signal for controlling the suction throttle valve is determined exclusively by the preliminary control. In order to increase the stability of the current control circuit, filters are provided in the feedback branch.

The advantages of the invention reside in the elimination of the temperature dependency of the high pressure control, an improved emergency operation upon failure of the rail pressure controller for the same operating point and a secure emergency operation upon failure of the current measurement of the current control circuit.

A preferred embodiment of the invention will be described below on the basis of the accompanying drawings.

DESCRIPTION OF A PREFERRED EMBODIMENT

Figure 1:
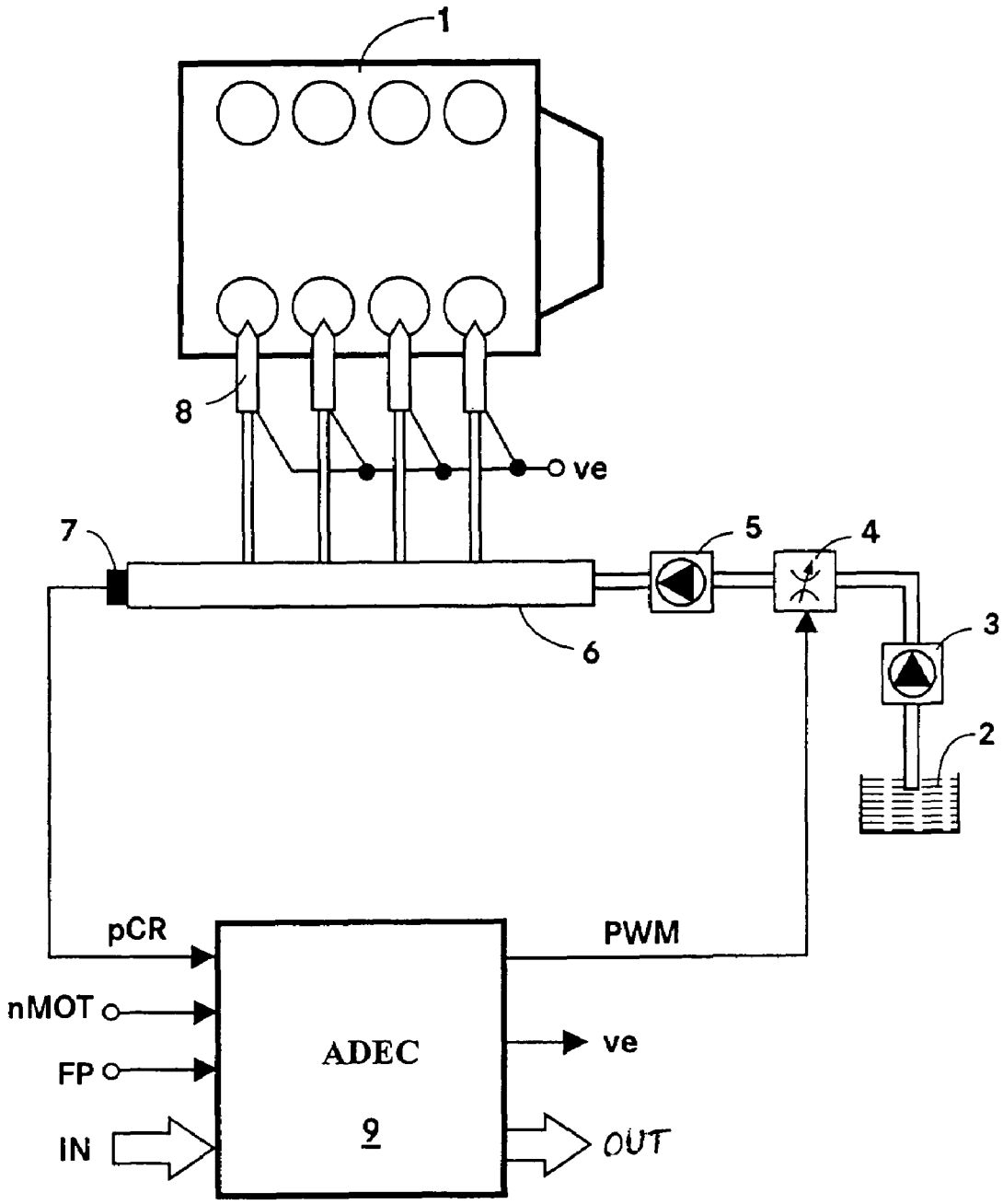
FIG. 1 is an overview of the control system.

FIG. 1 shows diagrammatically a system overview of an internal combustion engine 1 including a common rail fuel supply system. The common rail fuel supply system comprises the following components: a low pressure pump 3 for pumping the fuel from a fuel tank 2, a variable suction throttle valve 4 for controlling the fuel volume flow through the valve 4, a high pressure pump 5 for increasing the fuel pressure, a rail 6 for storing the fuel under pressure and injectors 8 for injecting the fuel from the rail 6 into the combustion chambers of the internal combustion engine 1.

The operation of the internal combustion engine 1 is controlled by an electronic control apparatus (ADEC) 9. The electronic control apparatus 9 includes the usual components of a microcomputer system such as a microprocessor, I/O components, a buffer and storage components (EEPROM, RAM). In the storage components, the operating data relevant for the operation of the internal combustion engine or stored by a performance graph/characteristic lines. By way of these data, the electronic control apparatus 9 computes from the input values the output values. In FIG. 1, the following input values are shown as examples: A rail pressure PCR, which is measured by a rail pressure sensor 7, an engine speed (rpm) nMOT, a signal FP indicating the power requirements of the operator and an input value EIN. As the input value EIN for example a charge pressure of the turbocharger, a charger speed and the temperatures of the coolant or the lubricant and also of the fuel may be subsumed.

In FIG. 1, as output values of the electronic control apparatus 9, a signal PWM for controlling the suction throttle valve 4, a signal ve for controlling the injectors 8 and an output value AVS are shown. The output value AVS is representative of the additional control signals for controlling the internal combustion engine 1, for example, a control signal for the activation of a second exhaust gas turbocharger in a register charging system.

In the common rail system shown in FIG. 1, the rail pressure pCR is measured directly at the rail 6; in a common rail system with individual storage chambers, the rail pressure pCR is measured either at the common supply line or in one or several of the individual storage chambers. With a pressure determination in several individual storage chambers, a representative rail pressure is determined as control value. The representative rail pressure may be established for example by forming an average of all measured individual storage chamber pressures or by selecting a particular storage chamber as representative for all the chambers. For the invention, this means that, in a common rail system with individual storage chambers, instead of a common rail pressure, a representative rail pressure is used. In the description, therefore under the rail pressure pCR also the representative rail pressure is to be understood.

Figure 2:
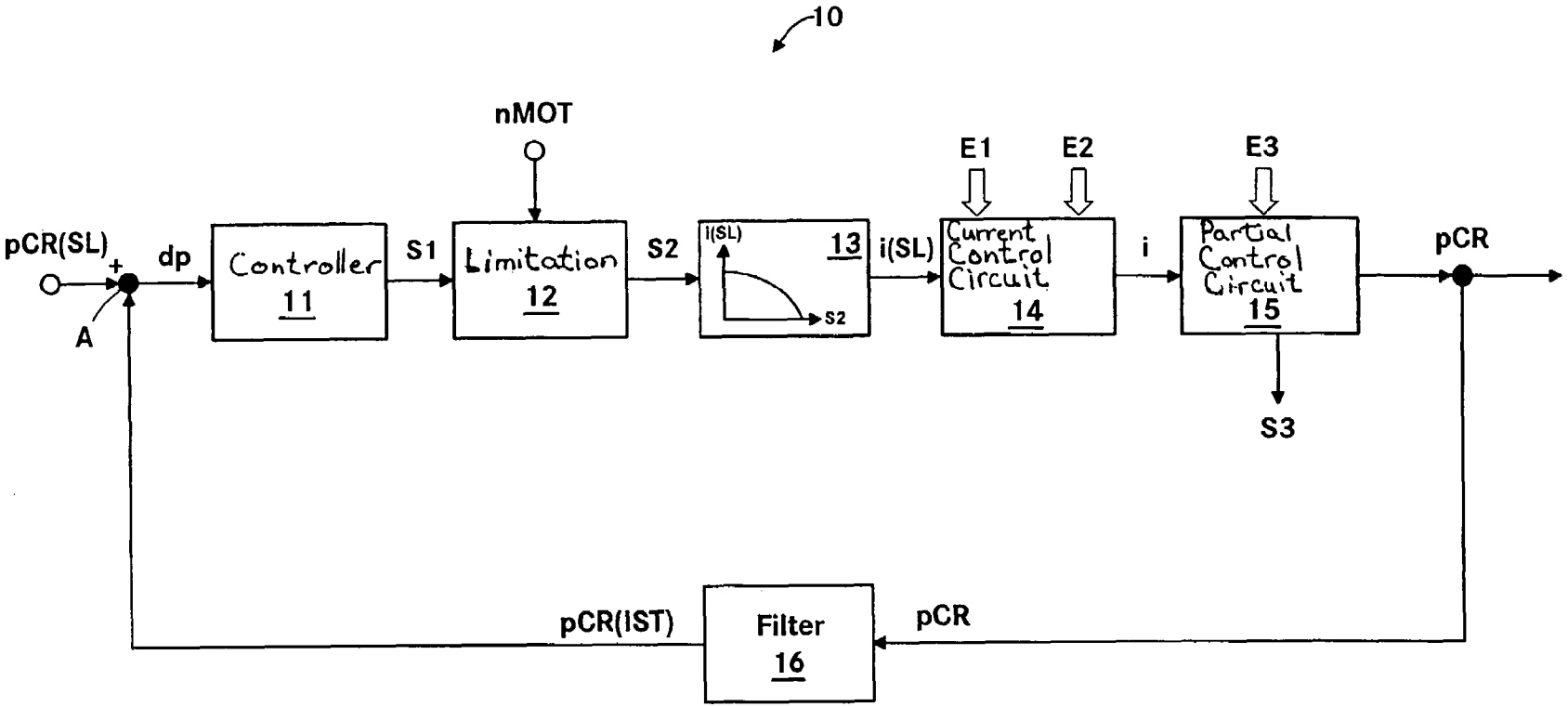
FIG. 2 is a block diagram of the rail pressure control circuit.

FIG. 2 shows a block diagram of the rail pressure control circuit 10. The rail pressure is controlled at the low pressure side of the common rail system where the pressure is established by the low pressure pump 3 at a pressure level of for example 10 bar. The input values of the rail pressure control circuit 10 are a rail pressure desired value pCR(SL), the engine speed nMOT and the input values E1, E2 and E3. In the input value E1, the control parameters of a current controller are included, for example, a proportional coefficient and a reset time. Under the input value E2, the values for calculating the PWM signal are combined, for example, a PWM base frequency, a transistor-resistance and a battery voltage. Under the input value E3, the input values for the mechanical part of the control path are combined, that is, the high pressure pump and the rail. The output values of the rail pressure control circuit 10 are a signal S3, which corresponds to an actual consumption volume flow and the rail pressure signal pCR. The rail pressure signal pCR includes in addition to the wanted signal also interfering signals which oscillate for example with the injection frequency and the pumping frequency of the high pressure pump. The wanted signal included in the rail pressure signal pCR is filtered out by way of a filter 16 and is compared as actual rail pressure value pCR (IST) at a summation point A with the desired rail pressure value pCR(SL). From this a rail pressure control deviation dp is obtained. From the rail pressure control deviation dp, a rail pressure controller 11 determines a control value S1, typically a desired volume flow in liter/minute. The control value S1 is then limited by a delimitation 12 depending on the engine speed nMOT. Optionally, a desired consumption volume flow may be added to the control value S1 (inference value intrusion). To the output value S2 of the delimitation 12, a desired current value i (SL) is assigned by way of a pump characteristic line. The desired current value i (SL) corresponds to the input value, that is, the guide value, of a current control circuit 14. The current control circuit 14 is described in connection with FIG. 3. The output value of the current control circuit 14 corresponds to an electric current flowing through the winding of the suction throttle valve 4, that is, the suction throttle valve current i. This current is the input value for a partial control path 15 which is representative of the mechanical part of the control path, that is, of the high pressure pump and the rail. The output value of the partial control path 15 corresponds to the rail pressure pCR. At this point, the control circuit is completed.

Figure 3:
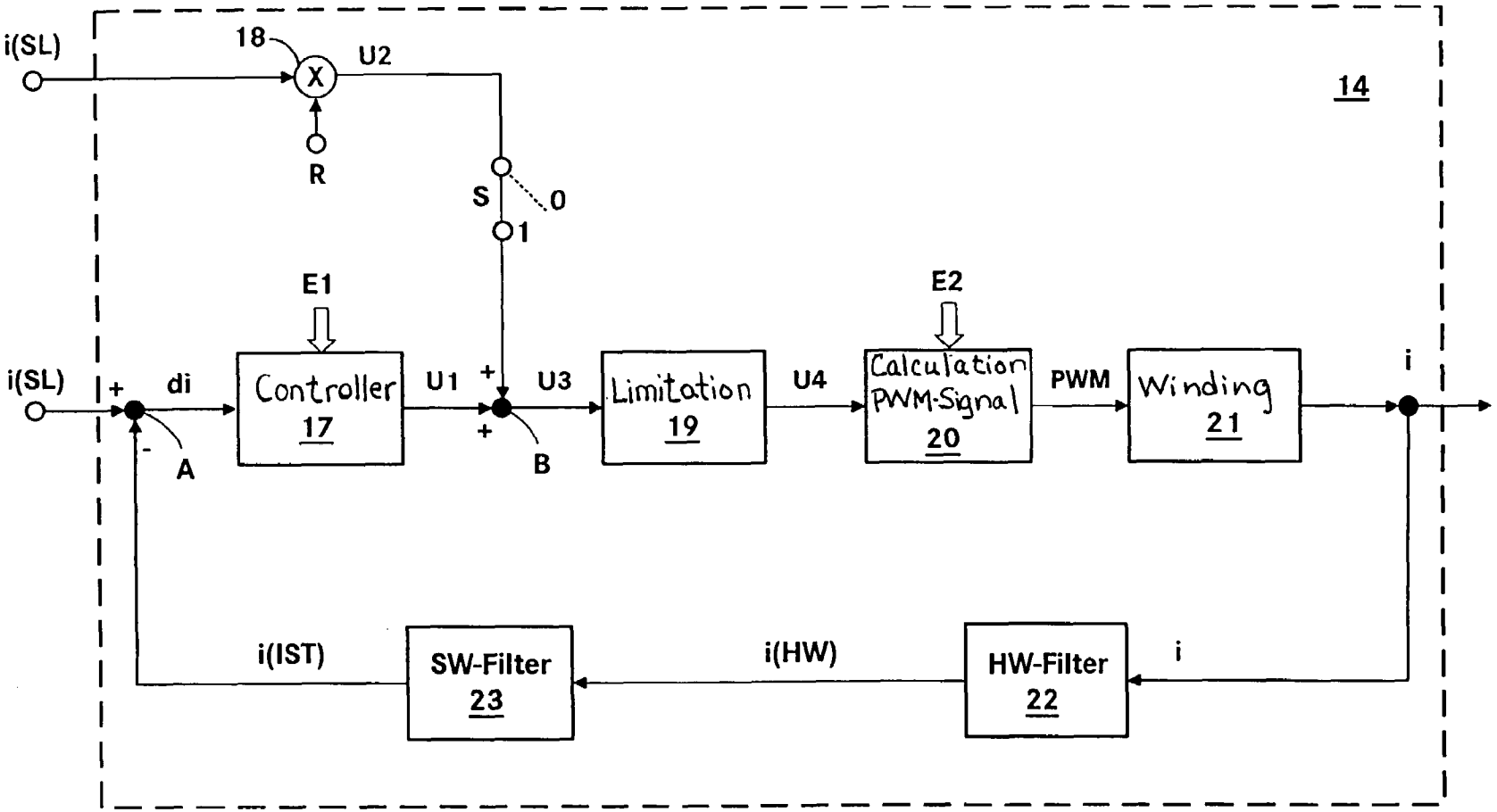
FIG. 3 is a block diagram of the current control circuit.

FIG. 3 shows a block diagram of the current control circuit 14 for controlling the suction throttle valve current, which flows through the winding of the suction throttle valve 4. The input values of the current control circuit 14 are the desired current value i(SL), see FIG. 2, and the input values E1 and E2. The input value E1 represents the control parameters for a current control 17. The controller parameters are a proportional coefficient kp, a reset time TN and a holding time TV. The input value E2 represents: a PWM base frequency, for example 100 Hz, a transistor resistor, the battery voltage and a cancel diode voltage. The output value of the current control circuit 14 is the suction throttle valve current i which represents the control value. The suction control current i has a periodic signal course, wherein the period is characterized by the PWM base frequency. Via the hardware filter 22 and the software filter 23 in the feedback branch, the suction throttle valve current i is filtered. The output value of the hardware filter 22 corresponds to a current filter value i(HW). The output value of the software filter 23 is an actual current value i(IST). At a summation point A, a current control deviation di of the desired current value i(SL) from the actual current value i(ST) is determined. From the current control deviation di, the current controller 17 then determines a first control value U1, typically a voltage value. The inner structure of the current controller 17 will be explained in connection with FIG. 4.

At a point B, a preliminary control value U2 is added to the first control value U1. The preliminary control value U2 also corresponds to a voltage. The preliminary control value U2 is calculated as the product of the desired current value i(SL) and the given constant ohmic resistance R of the winding and of the supply lines (multiplication point 18). The preliminary control can be activated (S=1) or deactivated (S=0) by a switch S. The sum of the first control value U1 and of the preliminary control value U2 corresponds to a sum value U3, which is limited by a limiter 19. The maximum value is the value of the battery voltage. A minimum value 0 volts is provided. The output value of the limiter 19, the limit value U4, is submitted to a PWM calculation 20. The PWM calculation 20 converts the limit value U4 to a pulse width modulated signal PWM with constant or variable base frequency. The conversion occurs dependent on the input value E2. The PWM signal is then supplied to the winding 21 of the suction throttle valve 4. By the suction throttle valve 4, the pump volume flow of the high pressure pump 5 is defined. The control is performed in such a way that the suction throttle valve 4 is fully open at a minimum PWM value, at which a maximum volume flow is established. The output value of the winding 21 corresponds to the suction throttle value current i. At this point, the control circuit is completed.

The arrangement has the following functional features: when the switch S is open (S=0), that is, when the preliminary control is deactivated, a pure cascade control arrangement is provided. The PWM signal is determined in the end from the current control deviation di. When the switch S is closed (S=1) that is the preliminary control is activated a deviation of the actual ohmic resistance of the winding 21 from the predetermined constant value R from the current controller 17 is corrected. Upon recognition of unreasonable values of the current filter value i(HW) or, respectively, of the actual current value i(IST) the current controller 17 is deactivated and, if the switch S is open (S=0) the switch is closed (S=1). In this case, the PWM signal is calculated exclusively from the preliminary control value U2. In this way, an emergency operating capability is established. As additional measure, it is possible that for—example with a break of the fuel admission line to the suction throttle valve 4—an engine shut-down procedure is initiated.

Figure 4:
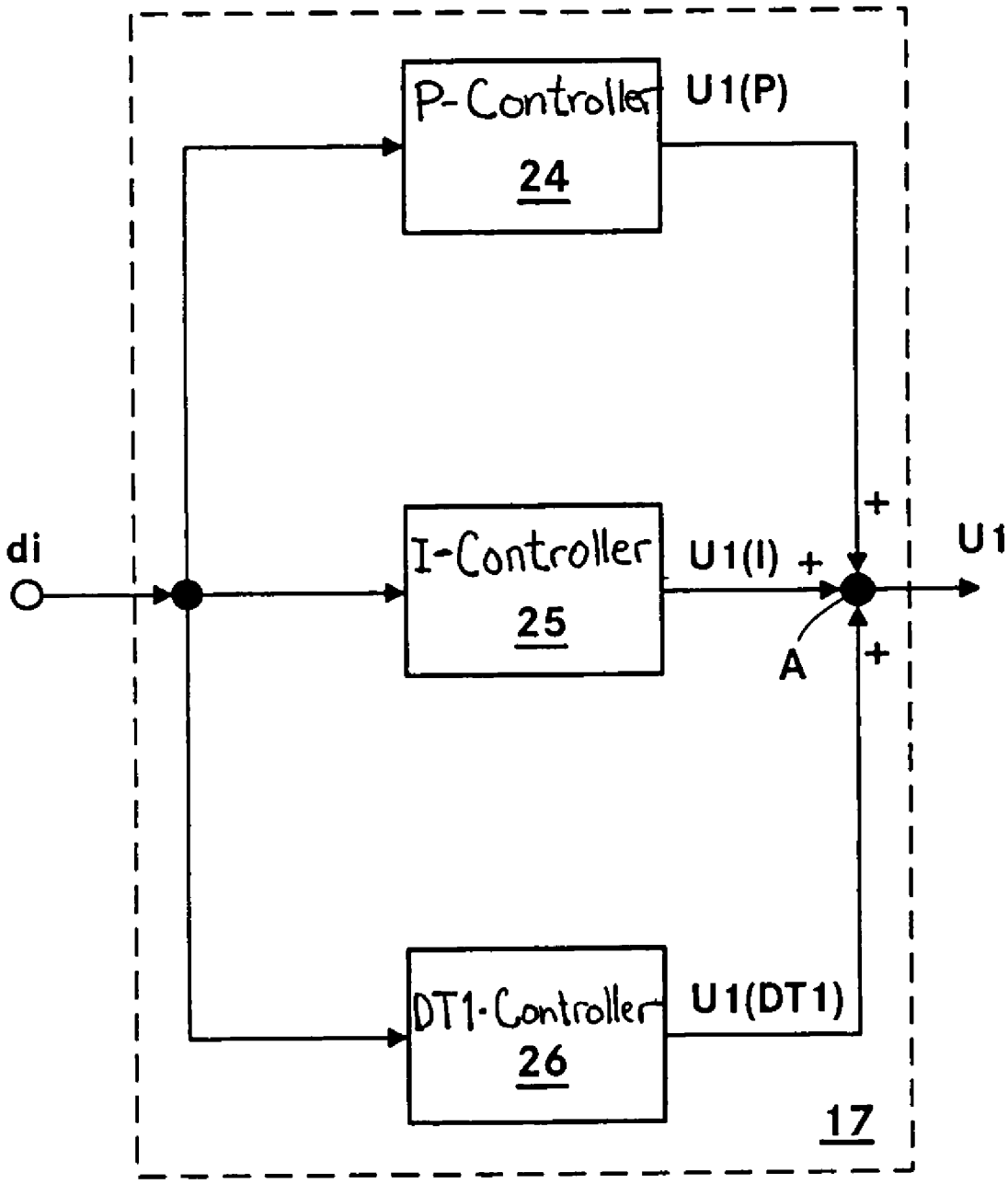
FIG. 4 is a block diagram of the current controller.

FIG. 4 is a block diagram showing the inner structure of the current controller 17. The input valve of the current controller 17 corresponds to the current control deviation di. The output value corresponds to the first control value U1 which, in the present case, is a voltage value. The current controller 17 is in the form of a PIDTI—controller. By way of a P controller 24, depending on the current control deviation di a P component U1(P) is calculated. A proportional coefficient kp for the calculation of the P component U1(P) may be provided in the form of a constant value or it may be supplied via the ohmic resistance of the winding 21. The ohmic resistance of the winding 21 is calculated from the actual current value i(IST) and the limit value U4. When the switch is open (S=0) instead of the limit value U4 also the I component of the current controller 17 may be used. By way of an I controller 25, the I component V1(I) is calculated depending on the current control deviation di. The I component U1(I) is determined herein mainly from the proportional coefficient kp and the reset time TN. With the switch S open (S=0), the I component is limited to a maximum value which corresponds to the battery voltage while the minimum value is 0 volts. With the switch S closed (S=1), the I component is limited to the negative preliminary control value U2. A DTI component is calculated by way of a DTI controller 26 depending on the current control deviation di. The calculation is performed depending on the proportional coefficient kp, a holding time TV and a time constant T1. At a point A, the individual signal components are added up. This results in the first control value U1.

Figure 5:
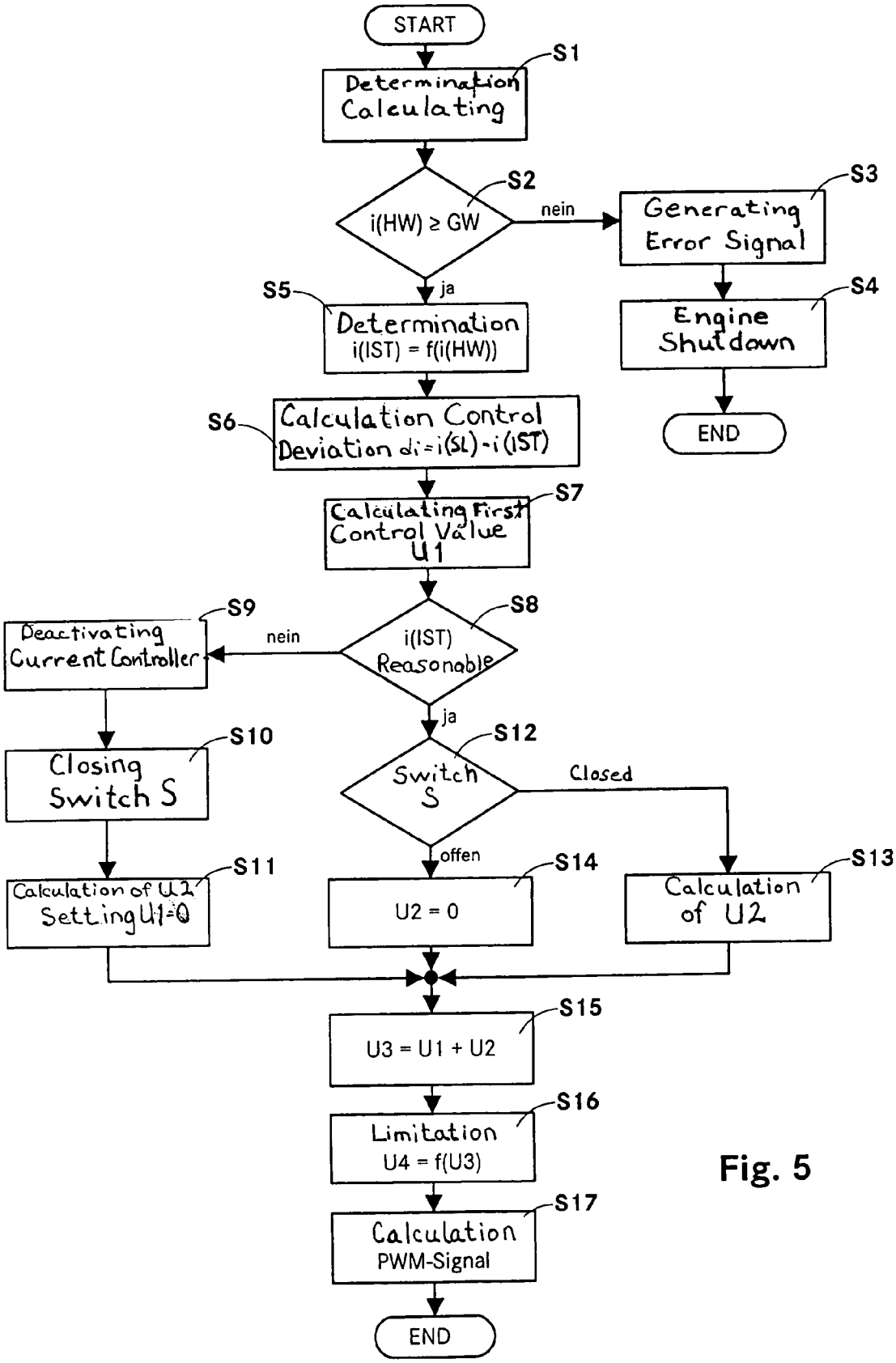
FIG. 5 shows a system flow diagram.

In FIG. 5, a diagram is shown for the performance of the program of the method. At SI, the suction throttle valve current I, which flows through the winding of the suction throttle valve is determined and from the suction throttle valve current i, a current filter value i(HW) is determined via the hardware filter. At S2, it is determined whether the current filter value i(HW) is acceptable, that is, whether it is greater than, or equal to, a limit value GW. If the current filter value i(HW) is below the limit value GW (no-path) at S3 an error signal is generated which indicates a current interruption. Subsequently, an engine shutdown is initiated. If it is found at S2 that the current filter value 1(HW) is greater than, or equal to, the limit value GW (yes-path), at S5 the actual current value I(IST) is calculated from the current filter value i(HW) by way of the software filter 23. At S6, The control deviation di from the comparison of the desired current value i(SL) with the actual current value i(IST) is determined. At S7, the first control value U1 is determined by means of the PIDTI algorithm of the current controller 17. Then at S8, it is examined by a diagnosis device, whether the actual current value I(IST) is reasonable or whether a measurement error is present. If it is determined at S8 that the actual current values I(IST) are not reasonable (no path) the current controller is deactivated, S9, and the switch S at S10 is closed (S=1). Then the preliminary control value U2 is calculated and the first control value U1 is set to the value 0, S11. Subsequently, this program part is continued at S15.

If at S8 reasonable values of the actual current value 1(IST) are recognized by the diagnosis device (yes path), at S12 the state of the switch S is examined. If the switch S is closed (S=1), at S13 the preliminary control value U2 is determined from the desired current value i(SL) and the predetermined constant ohmic resistance R of the winding and the supply lines. With the switch S open (S=0), the preliminary control value U2 is set to the value zero, S14. At S15, then the preliminary control value U2 and the first control value U1 are added up. The result corresponds to the sum value U3. At S16, the sum value U3 is limited, limit value S4. At S17, this value is converted to a corresponding PWM signal. At this point, the program is terminated.

From the description, the following advantages of the invention are apparent:

the high pressure control is independent of the temperature of the suction throttle valve;

in the leakage characteristic performance graph, for the same operating point an identical integral—component of the rail pressure controller is deposited, whereby the emergency operation is improved;

by way of the preliminary control an error protection is realized whereby, with a current measurement failure continued safe operation of the internal combustion engine is made possible in another way, a line interruption or a defective plug are clearly recognized and subsequently an engine shut-down is initiated, whereby the internal combustion engine is protected from excessive rail pressures.

What is claimed is:

1. A method for controlling the rail pressure (pCR) of a common rail system, comprising the steps of: determining a rail pressure control deviation (dp) from a comparison of a desired and an actual rail pressure, calculating a rail pressure control value from the rail pressure control deviation (dp) for the operation of a suction throttle control valve (4) via a rail pressure controller (11), wherein fuel admission to a high pressure pump (5) and consequently the rail pressure (pCR) is determined, determining from the rail pressure control value a desired current value (i(SL)) serving as guide value for a current control circuit (14) and for the calculation of a preliminary control value (U2), calculating an actual current value (i(IST)) via filters (22, 23) from a suction throttle valve current (i) which flows through the winding of the suction throttle valve (4), determining a first control value (U1) via a current controller (17) from a current control deviation (di) of the desired current value (i(SL)) from the actual current value (i(IST)), and determining the suction throttle valve current (i) by the first control value (U1) and the preliminary control value (U2).

2. A method according to claim 1, wherein the suction throttle valve current (i) is determined by a PWM calculation (20) from a sum value (U3) of the first control value (U1) and the preliminary control value (U2).

3. A method according to claim 2, wherein the sum value (U3) is limited by a limiting member (19) to a limit value (U4).

4. A method according to claim 3, wherein the sum value (U3) is limited to a maximum value which corresponds to the voltage of a battery and to a minimum value of zero.

5. A method according to claim 1, wherein the first control value (U1) is calculated by way of a current controller (17) with a PIDT1 behavior.

6. A method according to claim 5, wherein a proportional coefficient (kp) of the current controller (17) is provided as a constant value.

7. A method according to claim 5, wherein a proportional coefficient (kp) of the current controller (17) is provided depending on the ohmic resistance of the suction throttle valve (4) and the supply lines.

8. A method according to claim 7, wherein the ohmic resistance of the suction throttle valve (4) is calculated from the actual current value (i(IST)) and the limit value (V4).

9. A method according to claim 6, wherein, with the preliminary control deactivated—switch (S) being open (S=0)—the ohmic resistance of the suction throttle valve (4) is calculated from the actual current value (i(IST)) and an I component (U1(I)) of the current controller (17).

10. A method according to claim 5, wherein with the preliminary control deactivated—switch S opened (S=0)—the I component (U1(I)) of the current controller (17) is limited to a maximum value corresponding to the battery voltage.

11. A method according to claim 5, wherein with the preliminary control deactivated the I component (U1(I) of the current controller (17) is limited to a minimum value of zero.

12. A method according to claim 5, wherein, with the preliminary control activated—the switch S closed (S=1)—, the I component (U1(I)) of the current controller (17) is limited to a minimum value which corresponds to the negative preliminary control value (U2).

13. A method according to claim 1, wherein the actual current value (i(IST)) is determined via a software filter (23) from a current filter value (i(HW), which is calculated via a hardware filter (22) from the suction throttle current (i) and the current controller (17) is deactivated if the current filter values (i(HW)) or the actual current values (i(IST)) are unreasonable and the preliminary control value is used as the suction throttle valve current (i).

14. A method according to claim 1, wherein, upon recognition of a current interruption, an engine shut-down procedure is initiated.

15. An arrangement for controlling the rail pressure (pCR) of a common rail system in a rail pressure control circuit (10) comprising a rail pressure controller (11) for calculating a rail pressure control value from a rail pressure control deviation (dp) between a desired rail pressure (pCR(SL)) and an actual rail pressure value (pCR(IST)), a suction throttle valve (4) with a control winding (21) for controlling the supply of fuel to a high pressure pump (4) depending on the rail pressure control value, a current control circuit (14) for controlling the suction throttle control valve current (i) flowing through the control winding (21) of the suction throttle valve (4), the high pressure pump (4) having a pump performance graph (13) which is stored in the rail pressure controller (11) for determining a desired current value (i(SL)) as guide value for the current control circuit (14) and for determining a preliminary control value (U2) depending on the rail pressure control value, filters (22, 23) for determining an actual current value (i(IST)) from the suction throttle current (i), a current controller for calculating a first control value (U1) from a current control deviation (di) of the desired current value (i(SL)) from the actual current value (i(IST)), and a PWM calculation device (20) for determining the suction throttle valve current (i) to be applied to the suction throttle valve (4) depending on the first control value (U1) and the preliminary control value (U2).

16. An arrangement according to claim 15, wherein a hardware filter (22) and a software filter (23) are arranged in a feedback branch of the current control circuit (14).

17. An arrangement according to claim 15, wherein means (19) are provided for limiting a sum value (U3) of the first control value (U1) and the preliminary control valve (U2).

18. An arrangement according to claim 15, including a diagnosis arrangement for the surveillance of the current filter value (i(HW)) and of the actual current value (i(IST)), said diagnosis arrangement deactivating the current controller upon detecting an error and activating the preliminary control such that the suction throttle valve current (i) is determined solely depending on the preliminary control value (U2).

19. An arrangement according to claim 15, wherein a switch (S) is provided for the activation and deactivation of the preliminary control.

* * * * *